US006162030A

United States Patent [19]

Pierrat

[11] Patent Number: 6,162,030

[45] Date of Patent: Dec. 19, 2000

[54] ZERO LEAKAGE VALVELESS POSITIVE FLUID DISPLACEMENT DEVICE

[75] Inventor: Michel A. Pierrat, Boulder, Colo.

[73] Assignee: EncyNova International, Inc., Broomfield, Colo.

[21] Appl. No.: 09/096,519

[22] Filed: Jun. 12, 1998

Related U.S. Application Data

[60] Provisional application No. 60/049,535, Jun. 13, 1997, and provisional application No. 60/071,984, Jan. 20, 1998.

[51] Int. Cl.[7] ..... F04B 7/04

[52] U.S. Cl. ..... 417/497; 417/273; 417/466; 417/53; 92/60.5; 92/257

[58] Field of Search ..... 417/497, 254, 417/273, 251, 466, 53; 91/491; 92/257, 259

[56] References Cited

U.S. PATENT DOCUMENTS

| | | | |
|---|---|---|---|
| 1,349,667 | 8/1920 | Gogolinski | 417/466 |
| 2,981,201 | 4/1961 | Holdener | 417/466 |
| 3,884,125 | 5/1975 | Massie | 92/60.5 X |
| 4,443,163 | 4/1984 | Gaither | 417/466 |
| 4,625,683 | 12/1986 | Bonfilio | 91/491 X |
| 5,180,292 | 1/1993 | Abousabha et al. | 417/273 |

*Primary Examiner*—Timothy S. Thorpe
*Assistant Examiner*—David J. Torrente
*Attorney, Agent, or Firm*—Charles E. Rohrer

[57] ABSTRACT

A Positive Fluid Displacement Device (PFDD) with a removable Fluid Displacement Module (FDM) having two opposing pistons connected to a drive block. The drive block slides over a crankpin bearing in assembly to provide orbital piston motion. Opposing cylinders are held within a carriage for reciprocating motion. An opening in the reciprocating cylinder head allows fluid communication to the displacement chamber through inlet and outlet ports in a floating port plate. The flat surfaces of the port plate and cylinder head wipe across each other during cylinder head movement. The piston head carries a protrusion sized to fill the cylinder head opening. Micro-adjustment mechanisms for the position of the cylinder head together with compliant piston and compliant cylinder mechanisms can provide near zero dead volume. Different sized opposing cylinders enable the delivery of pumped fluids in precise ratios. By connecting the outlet of each cylinder to the inlet of the opposing cylinder, the differential displacement of the two cylinders can be pumped, enabling the delivery of very small quantities of fluid. High vacuum may be delivered by series connection of cylinders. The device may incorporate a dual lip piston seal which is wear compensated over the life of the seal. The PFDD is leakage free and can be driven by stepper motors to deliver a precise fluid amount at low speed even to an exact portion of a piston stroke. A sensor is provided for sensing cylinder head position.

53 Claims, 11 Drawing Sheets

ZERO LEAKAGE VALVELESS POSITIVE FLUID DISPLACEMENT DEVICE

This application claims the benefit of U.S. Provisional Patent Application No. 60/049,535, filed Jun. 13, 1997, and U.S. Provisional Patent Application No. 60/071,984, filed Jan. 20, 1998.

TECHNICAL FIELD

This invention relates to a Positive Fluid Displacement Device (PFDD) for transferring fluids. The PFDD provides precise fluid metering and incorporates opposing pistons which can be of different size to enable the delivery of fluid in a precise ratio.

BACKGROUND OF THE INVENTION

Positive Fluid Displacement Devices (PFDD's) are used extensively to meter and/or transfer fluids, either gas or liquids, in the medical and Industrial fields. Types of PFDD's include rotary (gear, vane), piston, syringe, diaphragm and peristaltic. All of these PFDD's have drawbacks which reduce their accuracy and efficiency, for example, gear, vane and piston devices generally have internal leakage problems which result in requiring high-speed operation to minimize volumetric losses.

Some types of PFDD's have a significant dead volume in the displacement chamber due to manufacturing tolerances, valves, seals etc., thus reducing the pressure ratio and accuracy, particularly critical in the transfer of gas, and making it difficult to eliminate air bubbles in the transfer of liquid.

Certain designs require lubricating oil to seal the displacement chambers of PFDD's, resulting in contamination of the transferred fluid (air compressors, vacuum pumps).

So called "dry lubricated" PFDD's often utilize Teflon® coated or Teflon-derived materials for moving wetted parts. Such devices are subject to the generation of particles during the wear process thereby contaminating the fluid.

Other designs of PFDD's with fixed clearances between moving wetted parts exhibit decreasing performance as wear takes place. Such devices often allow particles contained in transferred fluids such as slurries to be trapped between moving wetted parts, resulting in jamming or premature wear (vane, gear, piston).

Some PFDD's may damage the fluid, particularly liquids containing non-homogeneous material such as blood, due to large sealing surfaces creating shearing action to the liquid caught between the sealing surfaces (gear, vane, peristaltic).

In many PFDD's, it is difficult and often impossible to change the wetted parts to handle aggressive or dangerous fluids such as acids, bleaches, toxic, and abrasive substances without changing the entire device. Such devices generally do not satisfy the requirements of the chemical and medical fields in an economical fashion.

Some PFDD's incorporate abrupt changes of direction and lengthy restricted and/or convoluted internal fluid passageways thereby creating turbulent fluid flow and cavitation resulting in loss of accuracy and performance. Such design often renders it difficult if not impossible to flush and/or backwash the PFDD for cleaning purposes. Such devices are not suitable for metering the delivery or drawing of precise fluid quantities.

Many PFDD's lack precision in the volume delivered or drawn. This is especially the case with devices which have uncontrolled compliance in the pumping chambers (diaphragm, peristaltic).

Some PFDD's require valves and are not reversible. Such devices (piston, diaphragm) cannot be used to deliver or draw fluids by simple reversal of the driving motor. They are also unsuitable as flow meters.

Many PFDD's have a limited range of operation and lack low speed capability because accuracy of fluid displacement is lost when the volume of fluid displaced is reduced from rated capacity to near zero.

It is an object of this invention to provide a positive fluid displacement device which solves the many problems of prior art devices outlined above. This invention is based on the travelling cylinder concept described in U.S. Pat. No. 5,004,404, which is related to U.S. Pat. No. 4,907,950. In the travelling cylinder concept two opposing pistons are connected to each of two eccentrics or crankpins on a crankshaft. The opposing displacement chambers are secured together as one piece and are also connected to the crankshaft. Although the chambers are anchored to the crankshaft, they are permitted to move laterally in a direction perpendicular to the sliding direction of the piston inside the chamber. The outer end of each displacement chamber is provided with intake and exhaust openings. These openings mate with openings in the housing which encloses the device. The housing has exhaust channels to carry out the fluid delivered by the device. The intake port openings in the housing connect internally so that the incoming fluid is forced to flow around the internal moving parts for cooling purposes before entering the displacement chambers. The device described in U.S. Pat. No. 5,004,404 was developed for the pumping of air and was specifically oriented toward a device for supercharging internal combustion engines. A mechanism was provided to vary the displacement of the cylinders by changing the stroke of the pistons. The design of the prior art device was not capable of meeting all of the problems outlined above. In particular, it displayed some amount of leakage between the moving cylinder and the stationary ports in the housing; also, it was not designed for pumping liquids in precise, metered amounts.

SUMMARY OF THE INVENTION

This invention is a positive fluid displacement device (PFDD) in which a piston is driven in an orbital path, without angular motion in a third dimension, by a crankshaft that causes the piston to travel reciprocally inside a cylinder. The cylinder is mounted on a cylinder carriage for movement therewith. The cylinder carriage is guided by the housing to prevent angular motion while allowing a direction of travel perpendicular to that of the piston. The motion of the piston inside the cylinder displaces fluid within the cylinder, and the motion of the cylinder connects an aperture or opening in a cylinder head alternately to inlet and outlet ports located in a "floating" port plate mounted in the housing. The port plate is called floating because it is restrained on two axes inside the housing but free to "float" against the cylinder head in a third dimension. In that dimension, the port plate is urged against the cylinder head by appropriate mechanisms such as a spring. The cylinder head is secured to the carriage and is guided in its movement by the housing thus providing additional stability to the carriage in its linear reciprocal motion inside the housing.

A piston seal provides zero leakage and is wear compensated to continue zero leakage for the life of the seal. The piston head is shaped to provide near zero clearance with the cylinder head when it is at Top Dead Center (TDC) by including a protrusion which fills the aperture in the cylinder head. Since there are no valves, the dead volume is only the result of such near zero clearance, thus enabling the development of a high pressure ratio.

Sealing integrity between the cylinder head and the port plate is ensured by providing optically flat sliding mating surfaces which are pressured against each other by the spring interposed between the floating port plate and the PFDD housing. The spring only needs to overcome a pressure proportional to the area of the cylinder head opening, which is much smaller than the cylinder diameter. Since the areas of the sliding surfaces of the cylinder head and port plate are more than one order of magnitude larger, the Pressure Velocity Factor (PVF) is relatively small, ensuring a long life with negligible wear as well as ensuring fluid transfer with no leakage and 100% volumetric efficiency. The use of ceramic material for these parts virtually eliminates all wear as well as eliminating the generation of particles.

The fluid passageways through the port plate are large and short, with no recesses or sharp turns that would hamper fluid flow and backwashing or cleaning. Viscous fluids can be transferred with no cavitation or the need to pressurize the inlet.

For a balanced design, a fluid displacement module (FDM) is provided with two identical pistons, in line but opposite each other. The pistons are rigidly connected together by connection to a drive block which slides over a bearing assembly on the crank when the FDM is mounted in the PFDD. The pistons travel inside two separate but identical (except, perhaps, for size) cylinders. Both cylinders are tightly held by a common carriage. Each cylinder head is secured to the carriage for slidably mating with the port plates. The assembly of the drive block, pistons, cylinders, cylinder heads, and cylinder carriage is called a Fluid Displacement Module (FDM). The FDM can be quickly installed and removed from the housing of the PFDD and since the fluid contacts only those parts included in the FDM, only the FDM needs to be sterilized or replaced when dangerous fluids are pumped. The remaining parts of the PFDD, housing, driveshaft, crankshaft, motor coupling, motor, etc. do not come into contact with fluids and thereby can remain in place during changeover of the FDM's.

For an even more balanced design, a second FDM, identical to the one described above, is also connected to the single drive block. The second FDM is perpendicular to the first FDM. The pistons of each module are connected to the drive block and the moving elements of the FDM are all driven in assembly with the PFDD by the common crankshaft.

Because the cylinders and matching pistons of the FDM are all independent, different diameter cylinders can be selected during assembly of an FDM to achieve different mixing rates. For example, a displacement of 100% can be selected for a first cylinder, 80% for a second, 50% for a third and as low as 25% for the fourth. The maximum difference in cylinder diameter in the current design is 2:1. Whatever the selected mixing ratio, it will be maintained with the same accuracy at all flow rates, that is to say, since there is no leakage the fluid can be pumped at very low speeds at the selected ratio as well as at high speeds.

By virtue of the leak-free, valveless design, the invention enables the pumping of fluid for only a partial rotation, if desired, thus providing extraordinary metering capability. To accentuate the metering capability, the invention can be driven by a stepper motor through an exact number of cycles and/or a portion of a cycle to supply an exact amount of fluid, even in very small amounts. A sensor can be used to sense cylinder head position to enable stepper motor control of precise quantities.

Exceptionally small amounts can be delivered by utilizing a differential displacement connection together with the capability of the invention to use opposing cylinders of different size. With such a connection, very small volumes of fluid can be pumped and ratios of delivered fluids can be set from 25% to ratios below 1%. A differential displacement connection is achieved by connecting a fluid supply to the inlet port of a first cylinder; connecting the outlet port of that first cylinder to the inlet port of a second cylinder and to an outlet line; and connecting the outlet port of the second cylinder to the inlet port of the first cylinder. The result is an outlet volume equal to the difference in the displacement volume of the first and second cylinders. Coupling the differential concept with the capability of the invention to pump at low speeds and for portions of a single cycle gives the invention precise metering capability even to extremely small volumes as well as an almost unlimited capability of supplying fluids in a desired ratio.

Fastened to the housing of the PFDD, a manifold can be used to directly connect fluid passageways in the manifold to the floating port plates. The two or four cylinders can then be connected in series or parallel by the internal passageways of the manifold. In that manner, differential connections or any other type of connection can be implemented without using external tubing. O-rings are used to hermetically seal the connection between the manifold and the port plates. Consequently, any accidental leakage of fluid is contained inside the housing where it can be detected and disposed of appropriately.

For non-reversible applications, such as in vacuum pumps, or in transferring highly viscous liquids, port timing of the invention can be modified to favor suction or discharge flows. That is done by modifying the shape of the ports in the port plate so the time period that one of the ports is connected to the cylinder is favored over the other port. Thus, suction or discharge is favored to allow better filling or discharge of the cylinder.

Standard internally spring-loaded single lip seals may be used. However, for exacting applications when virtual dead volume is required, and difficult fluids have to be transferred, the invention provides a special dual lip seal designed with a precisely controlled spring to preload each lip of the seal against the cylinder and provide total sealing integrity over a longer life with more reliability than with a single lip seal. The spring does not come into contact with the fluid being transferred.

The invention can be used to provide exceptionally high vacuum. The pumped vacuum output of a first cylinder may be connected to the inlet of a second cylinder so that the outlet of the second cylinder produces an increased vacuum. The outlet of the second cylinder may be connected to the inlet of a third cylinder so that its outlet is a still higher vacuum. The serial connection scheme can be continued to still more cylinders for increased vacuum.

The invention is versatile. One cylinder can pump a slurry; a second cylinder can simultaneously pump water; a third cylinder can simultaneously deliver acid and a fourth cylinder can simultaneously produce a vacuum.

The invention can incorporate mechanisms for micro-adjusting cylinder displacement by altering the position of the cylinder head with respect to the position of the piston head at top dead center. Such an adjustment can be used to accentuate near-zero dead volume. The invention also can incorporate a compliant piston or a compliant cylinder so that should the piston head strike the cylinder head at top dead center, no damage ensues.

Thus, the invention provides a PFDD with zero internal leakage, near zero dead volume, 100% volumetric efficiency, precise metering capability, delivery of fluids in a precise ratio, and modular construction so that the parts which come into contact with the fluids can be quickly removed from the PFDD as one module for disposal, replacement, cleaning and/or sterilization.

DETAILED DESCRIPTION

Figure 1B:
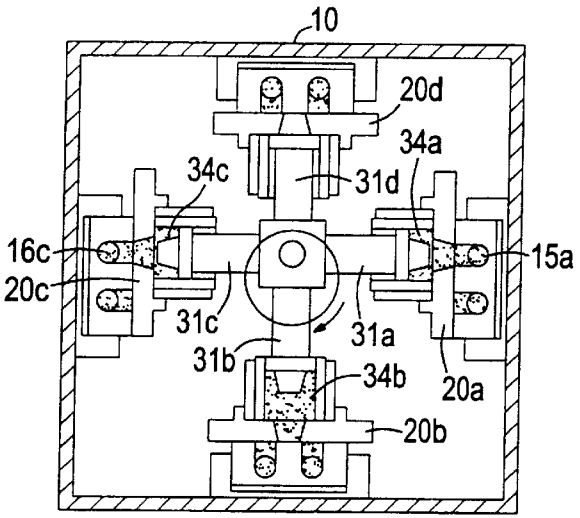
FIGS. 1A–1D are schematic illustrations showing the principles of the travelling cylinder concept as used in the current invention.

When reference is made to the drawing, like numerals will indicate like parts and structural features in the various figures. In the description, letter suffixes are used in connection with a generic number designation to indicate similar parts because many of the parts are identical in structure. The parts, even though in different locations, may be designated only by the generic number where the suffix is not essential to the description.

FIGS. 1A–D show the principle of the travelling cylinder concept as it is used in the structure of the invention. In these figures, a housing 10 encloses and supports the apparatus. Four pistons 31 are shown rigidly connected to a square drive block 27. Drive block 27 is mounted on a crankshaft by crankpin 56 for movement in a circular path 29. The FIGS. 1A–D illustrate a clockwise movement of the apparatus for purposes of explaining the principles of the invention. Counter-clockwise movement is also accommodated by the device in which case the exhaust port becomes the intake port and vice versa.

Each piston 31 is connected to a piston head 32 with a protrusion 30 on the piston head. Protrusion 30 is sized to fill an opening 28 located in the cylinder head 20. Cylinder head 20 is fastened to cylinder carriage 22. Cylinder 21 is mounted in cylinder carriage 22 and abuts against cylinder head 20. Port plates 14 are held by port plate holders 13 which are securely fastened to housing 10 and, if desired, may be integral therewith. Output ports 15 and inlet ports 16 (clockwise motion) are associated with each port plate. A recess 33 between the port plate holder 13 and the port plate 14 accommodates a spring (not shown) which urges the port plate 14 against the cylinder head 20.

Figure 1D:
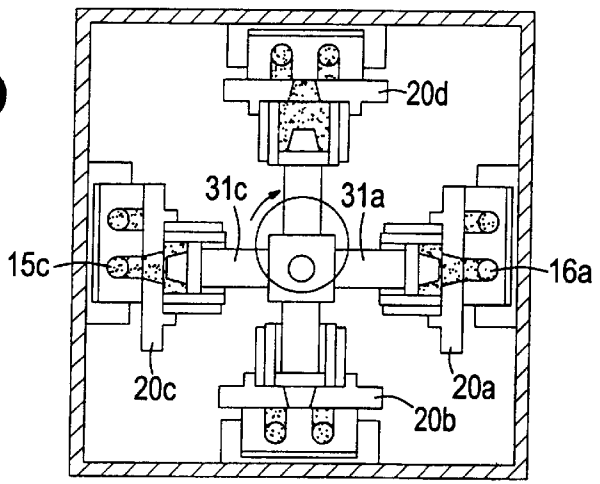
Figure 1A:
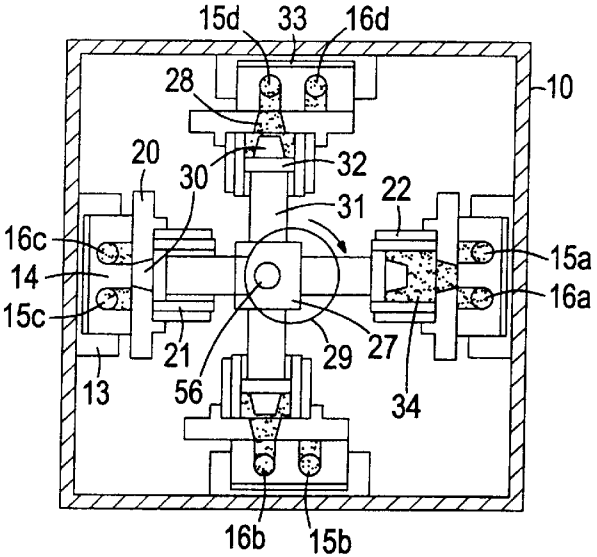

To illustrate the operation of the device, the horizontally disposed piston 31*a* associated with ports 15*a* and 16*a* is at bottom dead center in FIG. 1A. The opposing piston 31*c* associated with ports 15*c* and 16*c* is shown at top dead center with the piston head protrusion 30 filling the opening 28 in cylinder head 20, thus providing near zero dead volume.

In FIG. 1A the displacement chamber 34*a* associated with ports 15*a* and 16*a* is not in fluid communication with either port. Similarly, the displacement chamber 34*c* associated with ports 15*c* and 16*c* is not in fluid communication with either port. As shown in FIG. 1A, displacement chamber 34*c* has been reduced to near zero dead volume by virtue by the piston position at top dead center.

The piston 31*d* associated with ports 15*d* and 16*d* is at mid-position in FIG. 1A with the displacement chamber in fluid communication with port 15*d*. The opposing piston 31*b* associated with ports 15*b* and 16*b* is also in mid-position with the displacement chamber in fluid communication with port 16*b*.

When rotating in a clockwise direction, port 15 is an exhaust port while port 16 is an intake port. Thus port 15*d* is in the process of exhausting its associated displacement chamber 34*d* while port 16*b* is in the process supplying fluid to its associated displacement chamber 34*b*.

FIG. 1B illustrates the device after a 90° rotation of the crankshaft 23 in the clockwise direction. FIG. 1B illustrates that the cylinder head 20*d* has moved laterally toward the right and the displacement chamber 34*d* has been completely exhausted. Piston 31*d* is at top dead center.

The opposing piston 31*b* is at bottom dead center with its associated displacement chamber 34*b* at its maximum volume, having been completely filled through intake port 16*b*. The cylinder head 20*b* has moved toward the right, thus closing fluid communication between the displacement chamber 34*b* and either port.

The horizontally disposed pistons 31*a* and 31*c* are each at mid-position with displacement chamber 34*a* connected to exhaust port 15*a*. Cylinder head 20*a* has moved upwardly in a vertical direction from the position it had in FIG. 1A, thus enabling fluid communication between the displacement chamber 34*a* and the exhaust port 15*a*.

FIG. 1B shows that cylinder head 20*c* has also moved vertically in an upward direction enabling fluid communication between displacement chamber 34*c* and intake port 16*c*.

Figure 1C:
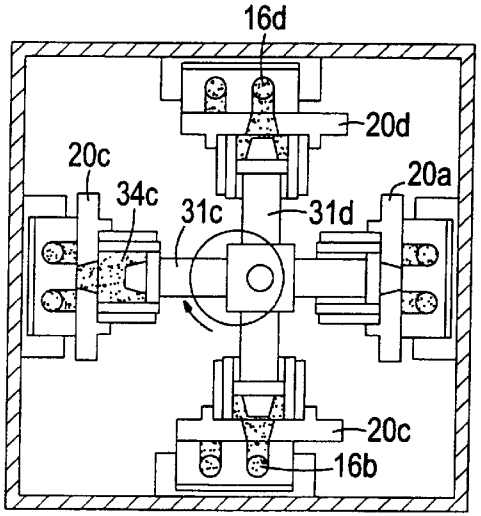

In FIG. 1C the crankshaft has rotated another 90° in the clockwise direction. In this position the displacement chamber 34*a* has now been completely exhausted and is no longer in view. Cylinder head 20*a* has moved in a vertical downward direction from its position in FIG. 1B such that the displacement chamber is not in communication with either port. Piston 31*b* has moved in a vertical downward direction from its position in FIG. 1B, while port plate 20*c* has continued to move toward the right, enabling fluid communication between displacement chamber 34*b* and the exhaust port 16*b*.

In FIG. 1C piston 31*c* has moved in a horizontal direction to the right and is at bottom dead center. Displacement chamber 34*c* has been completely filled and at bottom dead center is not in communication with either port.

In FIG. 1C piston 31*d* has moved in a vertical downward direction from its position in FIG. 1B and the displacement chamber 34*d* is in the process of being filled through its communication with intake port 16*d*. Cylinder head 20*d* has moved to the right in a horizontal direction from its position in FIG. 1B thus enabling communication of the displacement chamber 34*d* with the intake port 16*d*.

In FIG. 1D the crankshaft has moved another 90° such that displacement chamber 34*b* has been completely exhausted while displacement chamber 34*d* is now completely filled. Cylinder heads 20*b* and 20*d* have moved toward the left in a horizontal manner from the position shown in FIG. 1C, thus closing off fluid communication with the associated ports.

In FIG. 1D pistons 31*a* and 31*c* are now at mid-position with displacement chamber 34*a* in fluid communication with intake port 16*a* so that it is in the process of being filled. Displacement chamber 34*c* is in fluid communication with output port 15*c* and is in the process of being exhausted. Cylinder heads 20*a* and 20*c* have moved in a vertical downward direction from the position they had in FIG. 1C, thus enabling fluid communication with the associated inlet and outlet ports.

FIGS. 1A–D illustrate that the drive block 27 moves in a circular path. Since all four pistons are rigidly connected to drive block 27, all four pistons also move in a circular path. To understand the principle of operation, the drive block 27 is in contact (not shown in FIGS. 1A–D) with the cylinder carriage 22 and imparts a driving force to the carriage to move the cylinders in a reciprocating lateral motion. For cylinders 21*a* and 21*c* that motion is a reciprocating vertical motion. For cylinders 21*b* and 21*d* that motion is a reciprocating horizontal motion. Cylinder heads 20 fastened to the carriage 22 are moved in a reciprocating fashion with the cylinders, thus enabling the opening 28 in the cylinder heads to communicate with the inlet and outlet ports as the cylinder head slides on the surface of the port plate 14. This arrangement enables fluid communication to and from the displacement chambers without the use of valves.

Note that the port timing is always optimized. Maximum fluid communication between the displacement chambers and the ports occurs when the piston is travelling at maximum speed. The piston is at rest when the device switches from inlet port to outlet port and vice versa. Conversely, the cylinder head is moving at maximum speed when the device switches from port to port and is at rest when fluid communication is greatest.

Figure 2:
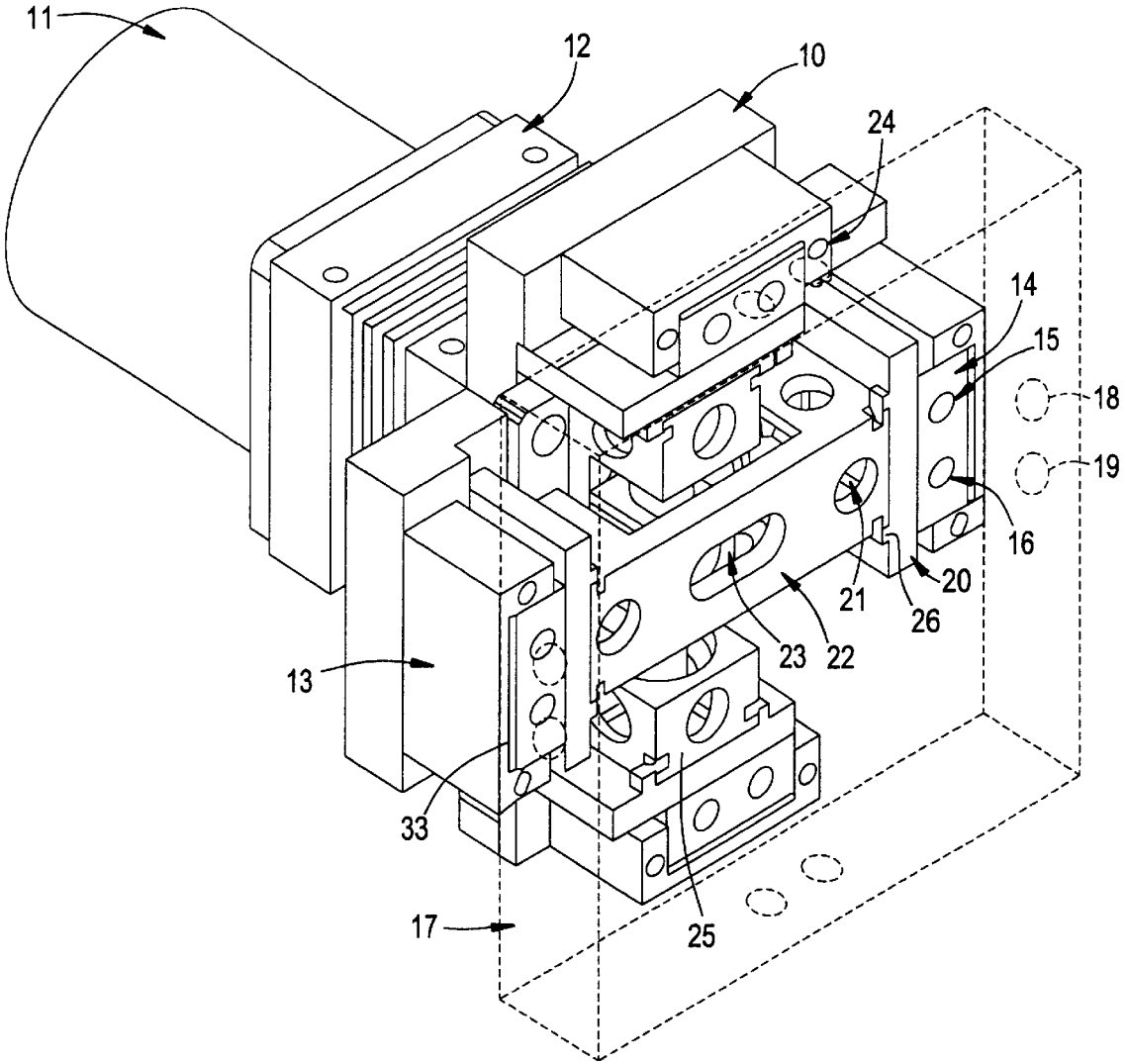
FIG. 2 is a perspective view of the invention showing a transparent manifold and a servomotor.

FIG. 2 is a perspective view of the PFDD of the invention showing the housing 10 and four port plate holders 13. The port plate holders are rigidly fastened to the housing 10 and may be integrated therewith. Port plates 14 are located in the port plate holders 13 and contain outlet ports 15 and inlet ports 16. Port plates 14 are restrained from motion in two dimensions by the housing 10 and port plate holders 13. Motion of port plates 14 is allowed in one direction toward the associated cylinder head under the urging of a spring (not shown) located in the recess 33.

The unit is enclosed on the front side by a manifold 17 which is mounted on the housing through mounting holes 24. Only the outline of the manifold 17 is illustrated in FIG. 2 in order to bring other components into view. Ports 18 and 19 in the manifold communicate with associated inlet and outlet ports 15 and 16 in the port plates 14. Four sets of manifold ports 18 and 19 are shown, thus enabling separate fluid communication to each of the four cylinders of the device shown in FIG. 2. Manifolds can be custom made to provide passageways for a variety of port connections.

Cylinder carriage 22 holds the two horizontal cylinders 21 within it while cylinder carriage 25 holds the two vertical cylinders. The cylinder carriages are identically constructed with the front side of cylinder 22 being the back side of cylinder 25, and vice versa, so that they fit together in assembly with the PFDD. Cylinder head 20 is shown with a lip 26 engaging a groove in the cylinder carriage 22.

FIG. 2 shows a driving motor 11 connected to the PFDD of the invention through a motor adapter 12. Drive motor 11 may be a servomotor and in many metering applications a stepper motor is desirable.

Figure 3:
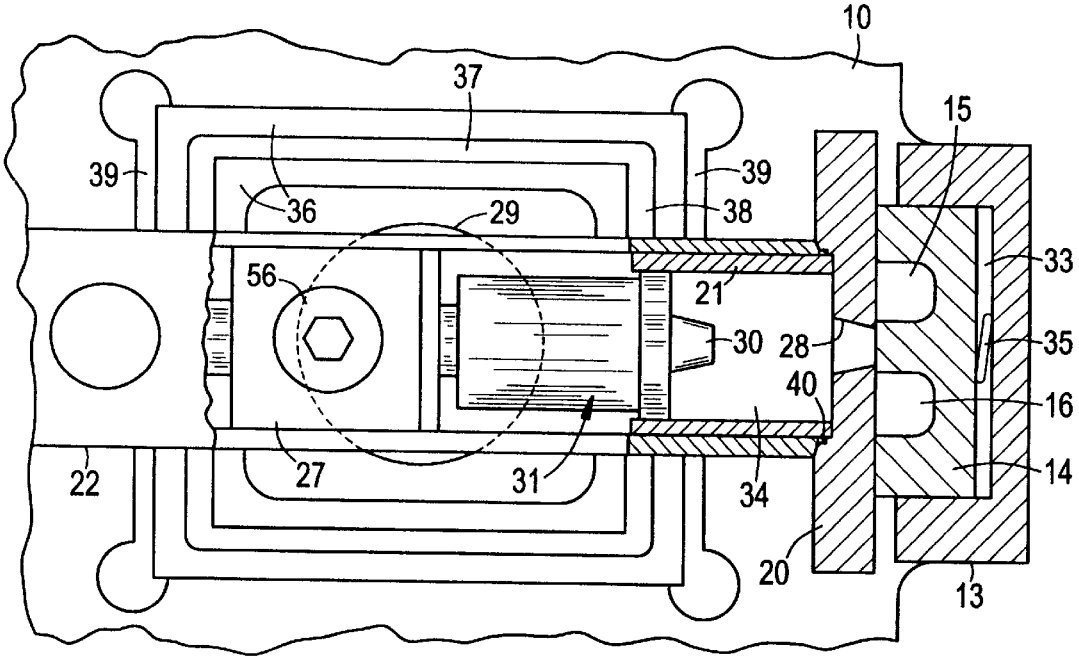
FIG. 3 is a front view of the device shown in FIG. 2 with several parts removed and other parts shown in partial cross-section.

FIG. 3 is a partial front view of the invention shown in partial cross-section. The vertical cylinder carriage 25 and all components associated therewith have been removed so that a view may be had of the interior surface of housing 10 at the back of the PFDD.

In FIG. 3 the horizontal cylinder carriage 22 is shown together with piston 31 and protrusion 30 on the piston head. It should be noted that the protrusion 30 is preferably made from compliant material such as tetrofluorethylene. The protrusion 30 is sized to fill opening 28 and the top of protrusion 30 is sized to come within a few tenths of a millimeter below the plane of the sliding mating surfaces of the cylinder head and port plate. In that manner, near zero dead volume is achieved at piston top dead center (TDC). The pressure ratio is defined as the ratio of the maximum displacement when the piston is at Bottom Dead Center ("BDC") to the volume left by the clearance between the piston and the cylinder head, when the piston is at TDC. Pressure ratios in excess of 150:1 are possible in the invention. Due to the simplicity of the piston connection to the crankshaft and the limited number of parts, it is easy to control the clearance to a few tenths of a millimeter by good manufacturing practice. Optionally, shims can be interposed between the piston and the drive block to bring the clearance to virtually zero.

Also shown in FIG. 3 are the cylinder head 20, opening 28 in the cylinder head, port plate 14, ports 15 and 16, the port plate holder 13, and a space 33 between the port plate holder and the port plate to accommodate a spring 35.

A frame 36 is mounted on the back surface of the housing 10. Frame 36 has horizontal grooves 37 and vertical grooves 38. A clearance space 39 is provided for adjustment of frame 36. Four-sided drive block 27 is mounted on a crankshaft by crankpin 56 which imparts a circular motion 29 to the drive block 27. Piston 31 is securely mounted in drive block 27 such that it also takes a circular motion. Cylinder 21 together with cylinder carriage 22 and cylinder head 20, move in a reciprocating vertical fashion.

Located on the back of the cylinder carriage 22, hidden from view in FIG. 3, is an extension lip which fits into vertical groove 38. As a consequence, when the cylinder carriage 22 is driven in a vertical fashion, the carriage lip located in vertical groove 38 guides the vertical movement and prevents any angular rotation of the cylinder. Cylinder carriage 22 is also held by the lips 26 of cylinder head 20 as shown in FIG. 2, and cylinder head 20 is guided by rails in the housing 10 as will be described, infra, thus providing stability to the structure.

An O-ring 40 is shown at the intersection of the cylinder head 20 with the cylinder 21. Cylinder 21 is also supported at the end opposite the cylinder head by ears on cylinder carriage 22 as will be shown, infra.

In FIG. 3 piston 31 is shown at bottom dead center. On the left side of cylinder carriage 22 there is another identical piston (not shown) at top dead center. Note that displacement chamber 34 is closed off from fluid communication with either port 15 or port 16.

FIG. 3 shows a spring 35 acting between the port plate holder 13 and the port plate 14 to urge port plate 14 into intimate engagement with cylinder head 20. In that manner, the flat surface of port plate 13 is urged against the flat surface of cylinder head 20.

Figure 4:
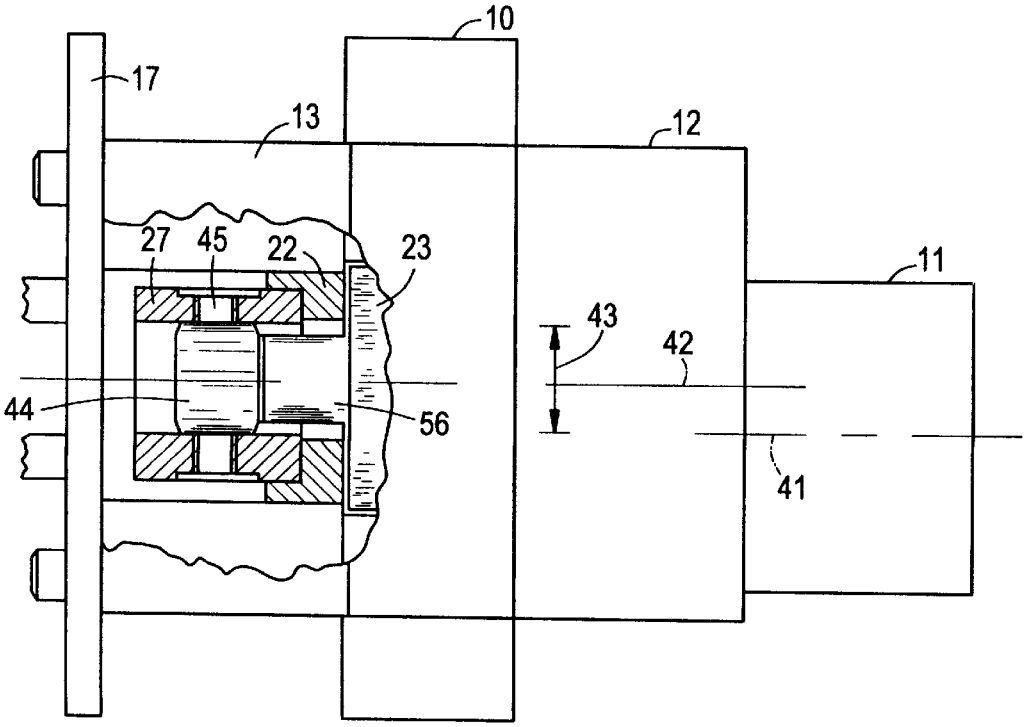
FIG. 4 is a side view of the device of FIG. 2, broken away to show various parts in cross-section.

FIG. 4 is a side view of the device showing motor 11 providing power to a driveshaft (not shown) along centerline 41 to a crankshaft 23. Crankshaft 23 is located along centerline 42, offset by gearing (not shown) from driveshaft 41. A crankpin 56 is connected to the crankshaft at a position offset from the centerline 42 of the crankshaft. However, in the view shown in FIG. 4, the centerline of the crankpin happens to coincide with centerline 42. Since crankpin 56 rotates around the crankshaft, arrow 43 is shown in FIG. 4 to indicate the limits of crankpin rotation around the crankshaft.

In FIG. 4 the housing and port plate holder 13 have been partially broken away and piston and cylinder components removed to show the bearing assembly 44 mounted between the crankpin 56 and the drive block 27. Threaded openings 45 are provided in the drive block 27 for screwing the pistons 31 into rigid connection with the drive block.

Figure 5:
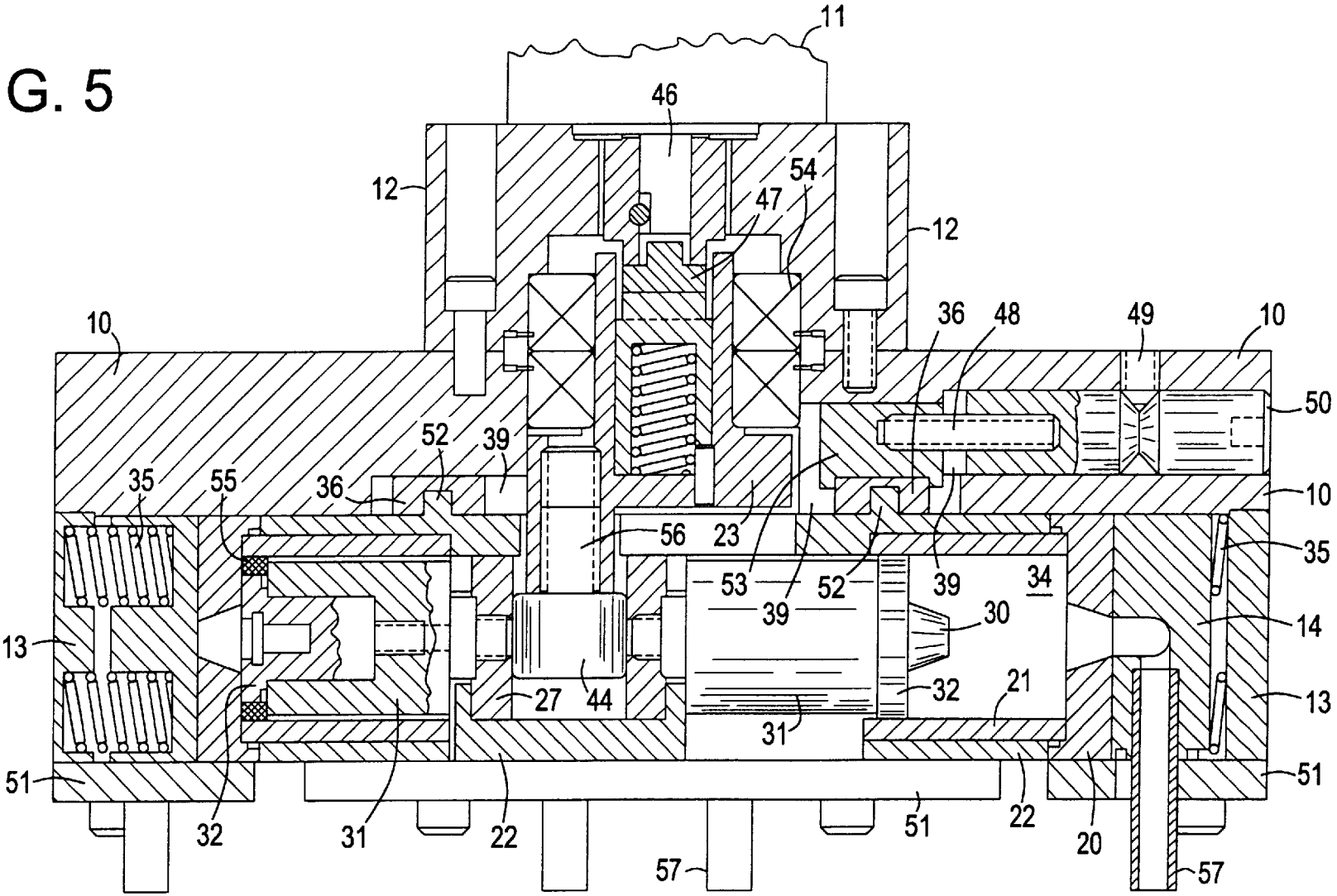
FIG. 5 is a top view of the device of FIG. 2, again showing various components in cross-section including mechanisms for micro-adjustment of the relative position of the cylinder head with the piston head.

FIG. 5 is a top view of the device shown in FIG. 2 with some modification. Instead of having a manifold to enclose the front end of the PFDD, FIG. 5 shows plates 51 for closing the front end and shows nipples 57 connecting to each port for fluid communication therewith.

In the cross-sectional top view shown in FIG. 5, the motor 11 with a driveshaft 46 is connected through an Oldam coupling 47 to the crankshaft 23. Crankshaft 23 is mounted in the housing 10 and the motor adapter 28 by bearings 54. A stud is mounted on crankshaft 23 to provide a crankpin 56 at an eccentric position to the centerline of crankshaft 23. Crankpin 56 carries a bearing assembly 44 upon which drive block 27 is mounted. The piston 31 is shown threaded into the drive block 27, and piston head 32 is similarly threaded into piston 31 (see left piston.) Piston head protrusion 30 is mounted in piston head 32. Piston seal 55 is held between piston head 32 and piston 31 and its periphery is in contact with the walls of cylinder 21.

Different cross-sections are taken of the left and right port plates 14, port plate holder 13 and spring 35 in order to show the mounting of spring 35 within the structure. On the right port plate the cross-section is taken through the center of a port, showing the connection to nipple 57. On the left port plate the cross-section is taken on the outside of the perimeter of the two ports to show the structure for mounting the coil spring 35 between the port plate 14 and the port plate holder 13. A different and simpler arrangement using a leaf spring is shown infra.

FIG. 5 shows mechanisms for micro-adjusting the volume of the displacement chamber 34. A threaded control rod 50 is located within housing 10. Leadscrew 48 is threaded into control rod 50 on one end and into block 53 on the other end. Block 53 carries lips into which frame 36 is mounted. Block 53 and frame 36 are held within the housing 10. Referring to FIG. 3, frame 36 is shown carrying grooves 37 and 38 into which ears of the cylinder carriage 22 are inserted. The ears 52 of cylinder carriage 22 are shown in FIG. 5 filling the vertical groove 38 in the frame 36.

As micro-adjusting rod 50 is turned, leadscrew 48 moves block 53, frame 36 and hence the cylinder carriage 22 toward the left. As cylinder carriage 22 moves toward the left the cylinder 21 and cylinder head 20 are moved with it toward the left, thus adjusting the volume of displacement chamber 34 to a slightly lower volume. Floating port plate 14 also moves toward the left and is retained in tight engagement with cylinder head 20 through the urging action of spring 35.

Figure 6:
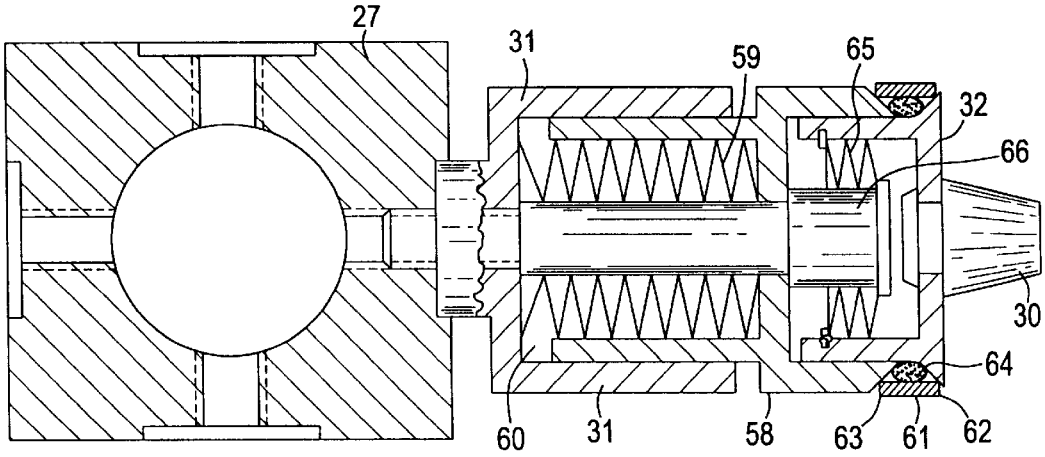
FIG. 6 is a cross-section of a piston with a compliant piston head.
Figure 7:
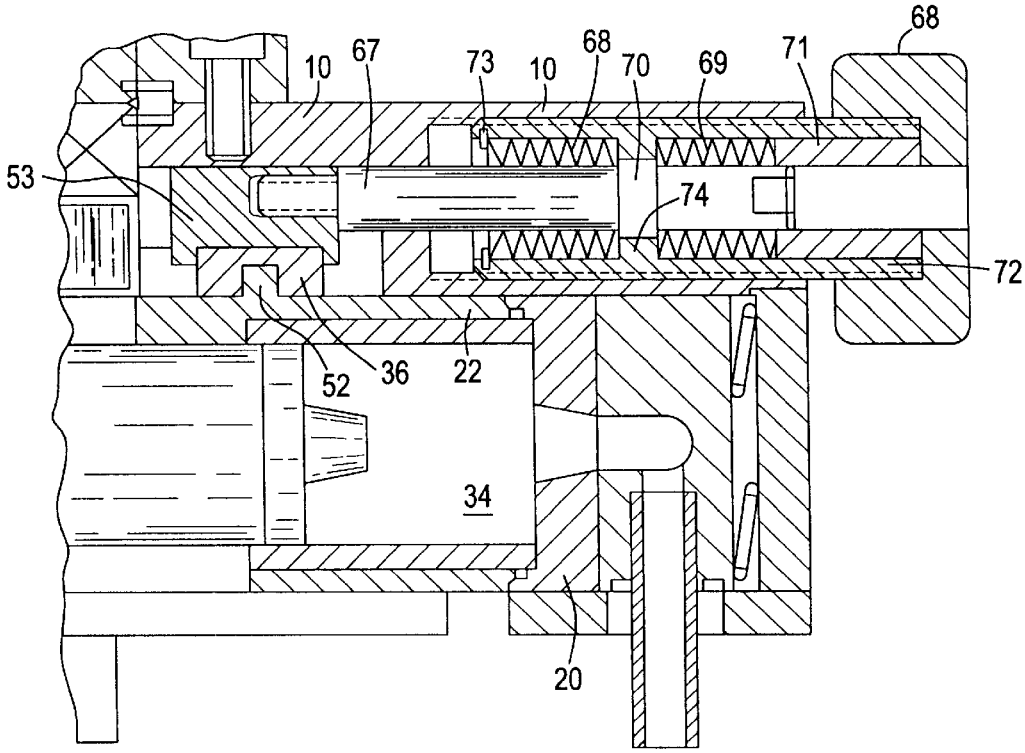
FIG. 7 is a cross-section of a compliant cylinder and also shows micro-adjustment of the cylinder head position.

Should the micro-adjusting rod 50 be turned too much, contact could occur between piston head 32 and cylinder head 20 and thereby cause damage to the structure. To enable such contact to occur and prevent damage, either the piston head or the cylinder must be made compliant. FIGS. 6 and 7 show compliant construction for those members.

It should be observed that if the rotating piston is used to impart a driving force to the cylinder in order that the cylinder, the cylinder carriage and cylinder head move in a reciprocating linear motion, a significant force would be placed on the piston seal. In the actual construction of the device, the piston seal is used for sealing rather than driving, and thus, driving forces on the piston seal are minimized. The cylinder, cylinder carriage, and cylinder head are driven by the drive block 27. Note that the drive block 27 is four-sided and that the cylinder carriage 22 is also four-sided (see FIG. 2.) In FIG. 5 the sides of drive block 27 are illustrated in contact with the sides of cylinder carriage 22. In that fashion, as the crankshaft 23 rotates, drive block 27 slides within cylinder carriage 22 along its longitudinal axis and simultaneously drives the cylinder carriage 22 along groove 38 in a direction perpendicular to the direction of piston travel. Thus, in FIG. 5 piston 31 is moved left and right while cylinder carriage 22 is moved in and out of the plane of FIG. 5.

As stated above, to prevent damage to the cylinder head or the piston, two types of controlled compliance can be introduced into the system. The first type, a compliant piston, is shown in FIG. 6. A piston 31 is solidly mounted into the four-sided drive block 27. A sleeve 58 is mounted within the piston 31 and is located between piston 31 and piston head 32. A spring 59 bears against piston 31 on one end and sleeve 58 on the other end to urge sleeve 58 against stud 66. Should piston head 32 contact the cylinder head, a clearance space 60 is provided to absorb the contact, compress spring 59, and prevent damage to the structure.

Figure 12:
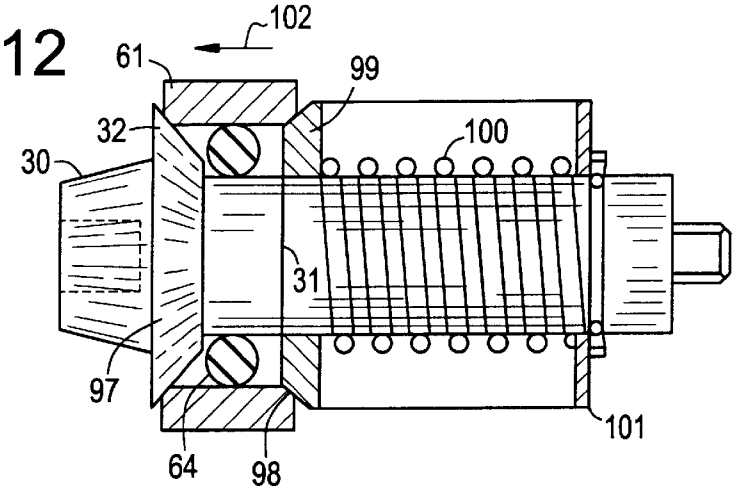
FIG. 12 is a partial cross-section showing a dual lip seal for use with the invention.

A dual lip seal is also illustrated in FIG. 6. Piston ring 61 is held against the walls of the cylinder (not shown) through pressure exerted by two conical surfaces, one on the piston head 32 and the other on sleeve 58. An O-ring 64 is also located between the conical surfaces and supports the piston ring 61. A spring 65 is held by stud 66 on one end and exerts urging pressure on the piston head 32 on the other end so that piston ring 61 is squeezed between the two conical surfaces and moved outwardly against the walls of the cylinder. This arrangement provides a dual lip seal with the lips 62 and 63 of ring 61 being the elements of ring 61 in intimate contact with the walls of the cylinder. The dual lip seal is also shown in FIG. 12 for use with a non-compliant piston.

FIG. 7 shows the construction of a compliant cylinder. Cylinder carriage 22 has ears 52 which are located in a groove in frame 36. Frame 36 is mounted in block 53 which in turn is slidably mounted in housing 10. Stud 67 is threaded into block 53 and has a ring 70 of larger diameter at one end thereof. A hollow leadscrew 72 is provided with a control knob 68 at one end and a projection 74 extending from the inner diameter of the hollow leadscrew at a central point. The leadscrew also carries a retaining ring 73 for capturing a spring 68 between the projection 74 and the retaining ring 73. A bushing 71 is located at the control knob end of the hollow leadscrew 72. A second spring 69 is located between bushing 71 and projection 74. Stud 67 and the elements connected thereto, block 53, frame 36 and cylinder carriage 22 are held in proper position by spring 68.

To adjust the volume of the displacement chamber 34, micro-adjusting control knob 68 is turned to move the leadscrew 72 further into housing 10. This causes spring 69 to bear against the ring 70, thus pushing the stud 67 toward the left. In that manner, block 53, frame 36, and the cylinder carriage 22 are moved toward the left and displacement chamber 34 is slightly reduced in volume.

At top dead center, it could be possible for the piston head and cylinder head to come into contact. In such case, the cylinder head 20 is allowed to move toward the right in a compliant fashion. That motion is achieved by movement of frame 36, block 53 and stud 67 toward the right, with ring 70 moving within the hollow leadscrew to compress spring 69 and thereby prevent damage to the structure.

For most applications, micro-adjustment of cylinder carriage 22 is not needed. For those applications, the frame 36, the block 53 and all of the adjusting mechanisms are eliminated. In such case, the grooves 37 and 38 can be cut directly into the housing 10.

Figure 8:
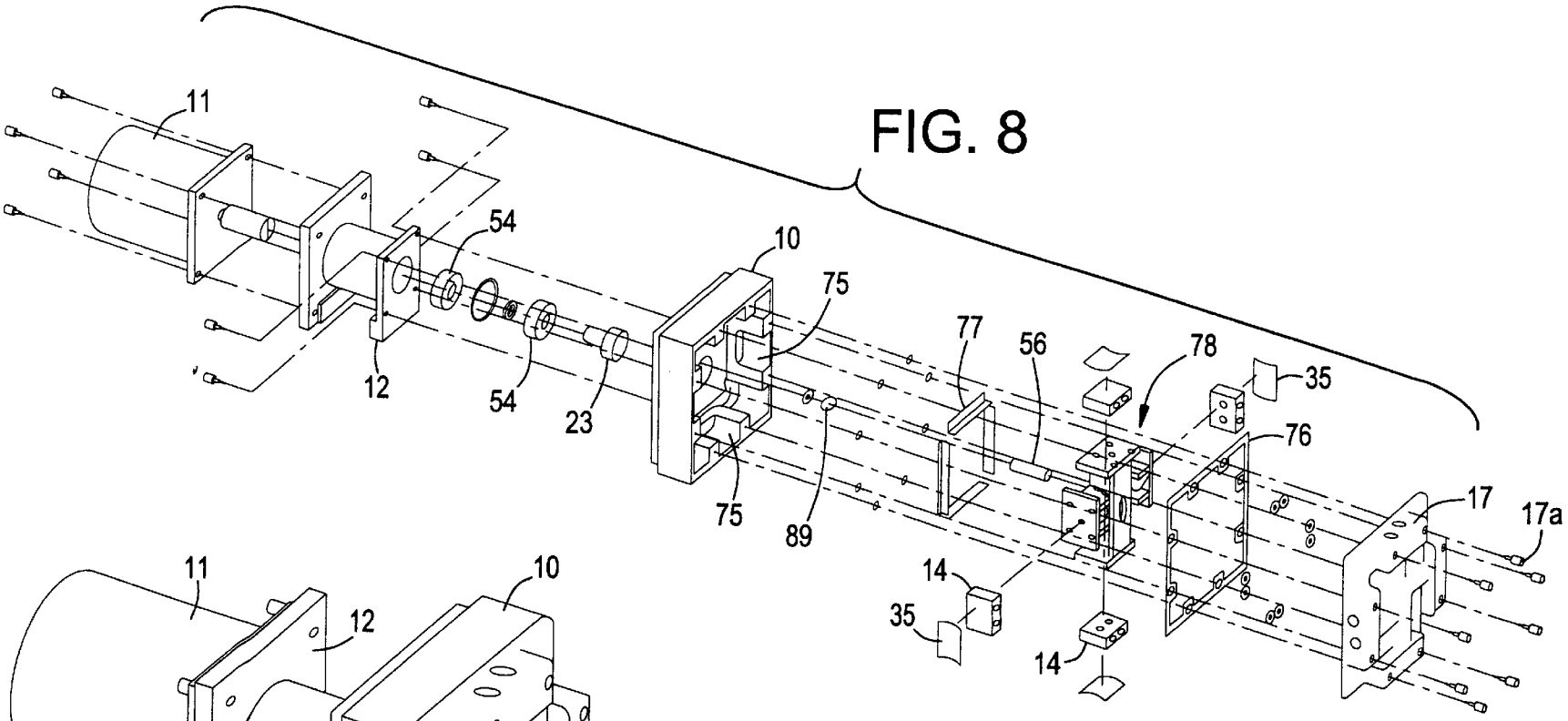
FIGS. 8 and 8A are an exploded view of the device of FIG. 2.
Figure 8A:
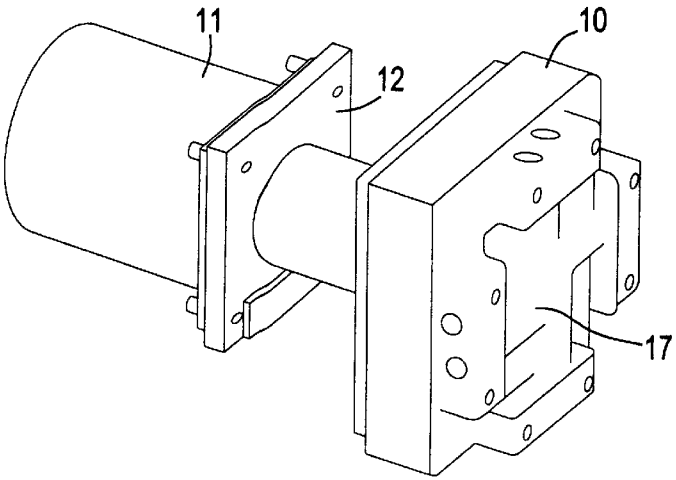

FIG. 8 is an exploded view of the invention with FIG. 8A showing the assembled device for ease of reference. A motor 11 is connected to a motor adapter 12 which is connected to the device housing 10 which is connected to the manifold 17. In the exploded view shown in FIG. 8, the crankshaft 23 is mounted in housing 10 and motor adapter 12 by bearings 54. The crankpin 56 is shown and is connected into the crankshaft 23 at a position distant from the centerline of the crankshaft.

Rails 77, made from self-lubricated material, are mounted in housing 10 for guiding the movement of the fluid displacement modules 78. There are two FDM's in the fluid displacement module assembly 78: a horizontal FDM in which the cylinder carriage/head assemblies are moved vertically, guided by the vertical rails 77; and a vertical FDM in which the cylinder carriage/head assemblies move in a horizontal plane guided by the horizontal rails 77.

Recesses 75 are included in housing 10 for holding the four port plates 14. In that manner, there is no need for separate port plate holders. Leaf springs 35 are utilized instead of the coil spring shown in earlier figures to bias the port plates 14 against the cylinder heads.

Manifold 17 is fastened to the housing 10 by screws 17*a* to compress a gasket 76 between the manifold and the housing. A sensor 89 is fastened to the housing. It is used to sense the position of the cylinder head and provide that information to control mechanisms for the drive motor 11.

Figures 9, 9A:
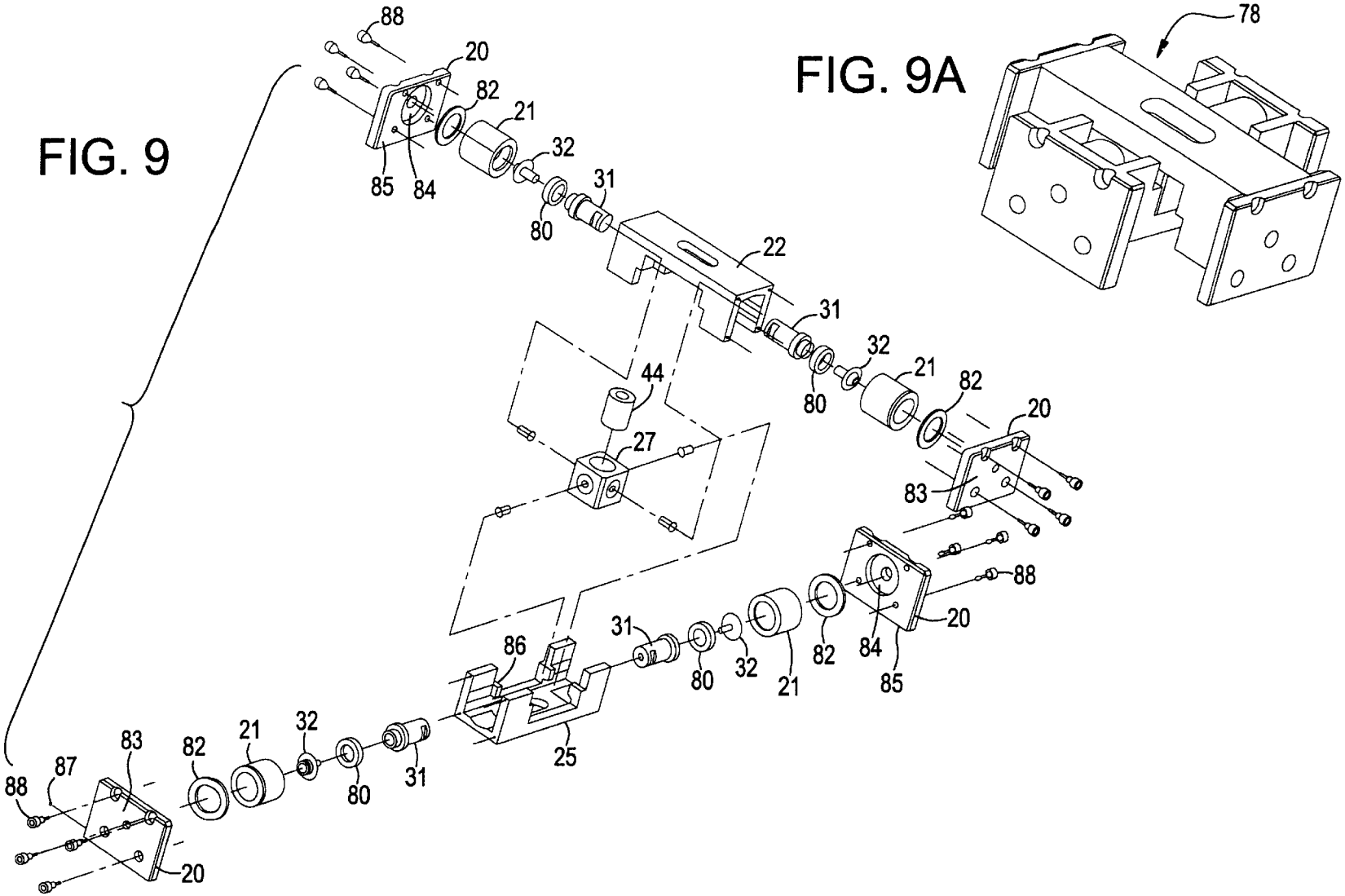
FIGS. 9 and 9A are an exploded view of the fluid displacement module of the invention.

FIG. 9A shows the fluid module assembly 78. Each of the two FDM's in assembly 78 includes a set of two opposing pistons and cylinders. FIG. 9 shows an exploded view of the fluid displacement module assembly 78. Note that there are two cylinder carriages, 22 and 25 shown in FIG. 9. These two structures are manufactured to fit together in a hermaphrodite manner to surround the drive block 27 in assembly.

In assembly, the drive block 27 surrounds the bearing assembly 44. The bearing assembly 44 fits within drive block 27 and over the crankpin 56. In one embodiment, bearing assembly 44 is not part of the FDM assembly 78, but rather is positioned on the crankpin 56 in the PFDD. In that embodiment, the drive block 27 slides onto the outer race of bearing assembly 44 to incorporate the FDM into the PFDD. In a second embodiment, bearing assembly 44 is integral with the drive block and the inner race of bearing assembly 44 is slid over the crankpin to incorporate the FDM into the PFDD.

Cylinder heads 20 are fastened by screws 88 to the cylinder carriage 22 to form cylinder carriage/head assemblies. Cylinder 21 is held within a recess 84 in the cylinder head 20, and when assembled, a gasket 82 is compressed between cylinder head 20 and cylinder 21. A projection 86, shown in cylinder carriage 25 acts to axially restrain the cylinder 21 at an end opposite the cylinder head. Thus, in the FDM assembly, the cylinder is tightly held between the projection 28 and the cylinder head 20.

The cylinder head 20 includes a surface 85 which bears against and slides on the rails 17 in the housing 10. In that manner, cylinder head 20 gives additional support and stability to cylinder carriage 22. Cylinder carriage 22 is also guided by grooves 37 and 38, described previously, and is supported and driven by drive block 27.

The surface 83 of cylinder head 20 is the flat surface that slidably mates with the flat surface of the port plate 14. To secure a fluid tight assembly, those two opposing surfaces should be made as flat as possible. Therefore, each of those surfaces is lapped during manufacture to a flatness of a single lightband. The cylinder heads 20 are of simple geometry and can be made from ceramic material. They require no secondary finishing except for the lapping operation of the sliding surface 83.

A magnet 87 secured to the cylinder head 20 is used to interact with sensor 89 shown in FIG. 8 to sense the position of the cylinder head and can be set to indicate the top dead center position of the piston corresponding to the position of the cylinder head. By sensing the cylinder head position, data is provided to the motor controller to enable accurate movement of the pistons for any particular number of cycles or for even a portion of a single cycle. Such controllers are available through National Control Corporation, Chicago Ill. The motor 11 can advantageously be a stepper motor for use with the sensing mechanisms.

Piston 31 and piston head 32 surround and squeeze the piston ring 80.

Figure 10:
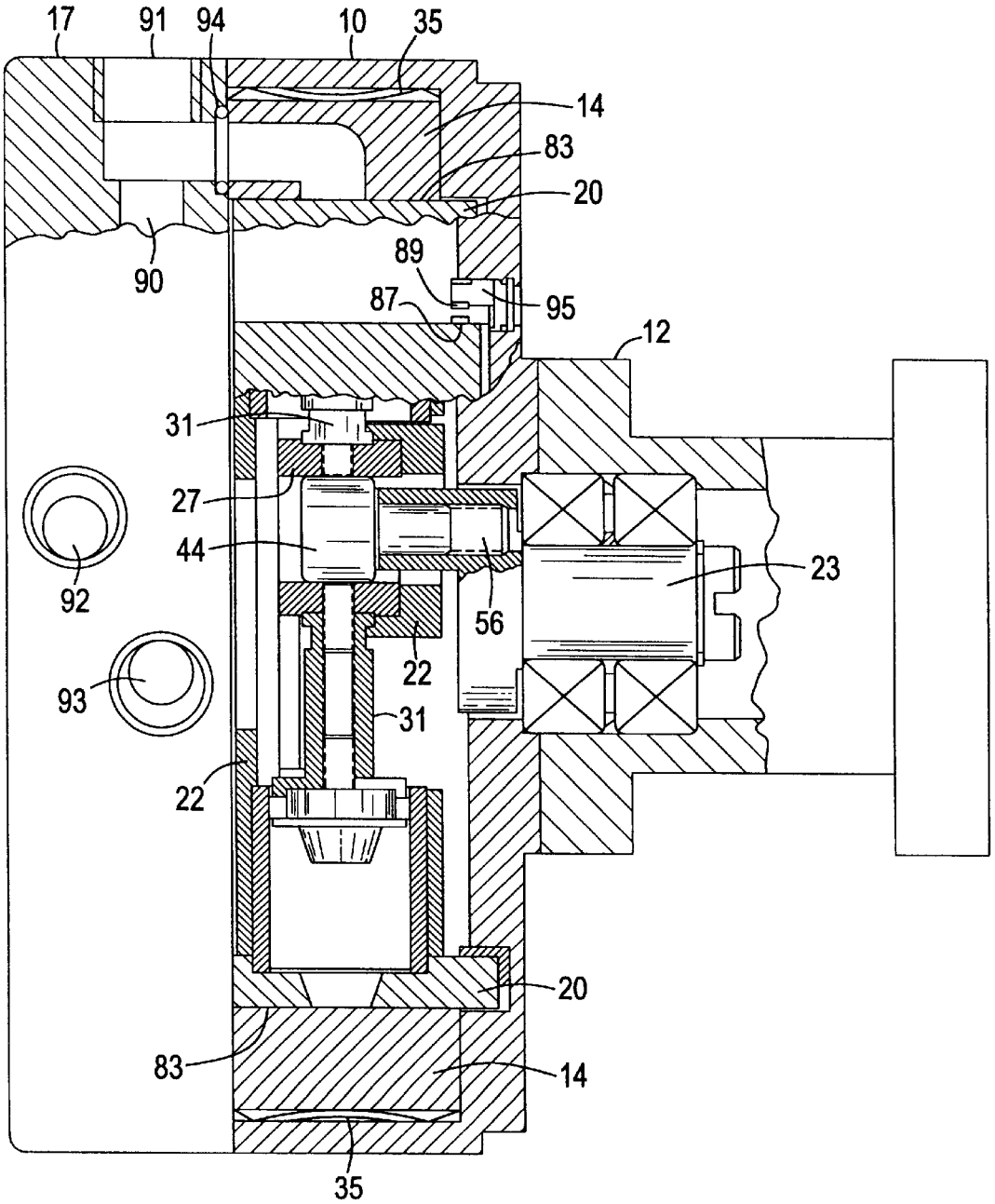
FIG. 10 is another side view of the invention showing sensing elements for servomotor control.

FIG. 10 is another side view of the device in partial cross-section. Manifold 17 is shown connected to the housing 10 which in turn is connected to the motor adapter 12. Manifold 17 has a port 91 which may be plugged so that the internal passageway 90 within the manifold can connect from a port on one cylinder to the port of a different cylinder. Fittings on the manifold are shown at 92 and 93 for intake and outlet.

FIG. 10 illustrates an O-ring 94 located between the manifold 17 and the port plate 14. The port plate is enabled in assembly to move in a floating manner under the influence of spring 35 to maintain tight engagement with the cylinder head 20. The movement of port plate 14 is generally quite small, and therefore O-ring 94 is enabled to provide a leakage-free assembly to manifold 17.

The optically flat lapped surfaces 83 of the port plate 14 and the cylinder head 20 are the abutting surfaces which slide against one another in operation.

A sensor 89 is located in a sensor holder 95 within the housing 10. Sensor 89 interacts with magnet 87 located on the cylinder head 20 in order to sense the position of the cylinder head.

The crankshaft 23 drives crankpin 56 which in turn rotates the drive block 27 which is mounted on crankpin 56 by bearing assembly 44. Cylinder carriage 22 is shown in abutting relationship with the drive block 27 in order to be driven thereby in a reciprocating fashion as previously discussed.

Figure 11:
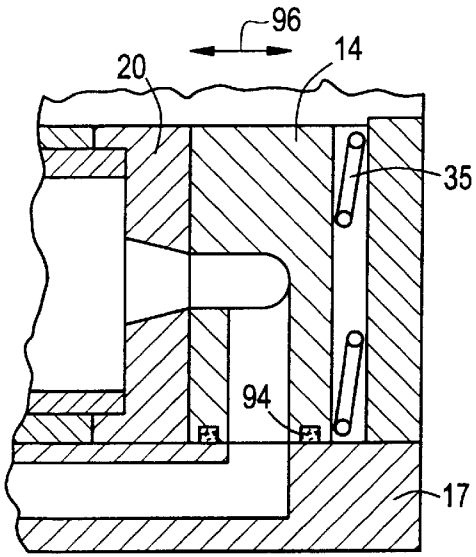
FIG. 11 is a cross-section showing the connection of the manifold to the port plate.

FIG. 11 is a cross-section showing the connection of the manifold 17 and the port plate 14. Port plate 14 is allowed to move as shown by arrows 96 relative to the manifold 17 under the urging of spring 35 in order to keep intimate contact with cylinder head 20. O-ring 94 is used to seal the connection between port plate 14 and the manifold 17.

Figure 13:
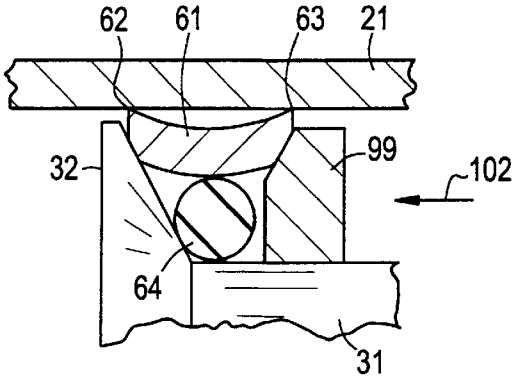
FIG. 13 is another illustration of the dual lip seal.

FIGS. 12 and 13 show the dual lip seal assembly for the piston head 32. The piston ring 61, preferably made of compliant material such as tetrofluorethylene or an Ultra High Molecular Weight (UHMW) polystyrene, is captured between conical surfaces 97 and 98. Conical surface 97 is part of the piston head 32 while conical surface 98 is part of a sleeve 99. An O-ring 64 is located between sleeve 99 and conical surface 97 under the piston ring 61 to provide support to the piston ring. Spring 100 is captured between retaining ring 101 on piston 31 and sleeve 99 to urge sleeve 99 in the direction 102. The dual lip seal shown in FIG. 12 is similar to the dual lip seal shown in FIG. 6 except that in the configuration shown in FIG. 12 the piston is not a compliant piston and therefore the entire assembly is somewhat simplified.

FIG. 13 shows, in accentuated form, the production of lips 62 and 63 when the piston ring 61 is squeezed against the walls of a mating cylinder 21 through the forces produced by spring 100. The two lips 62 and 63 bear against the walls of the cylinder to form a dual lip seal. This design provides excellent control of the pressure applied by the lips against the cylinder.

In customary seal design, the spring is internal to the seal and has a steep spring rate because of the limited space available inside the seal. This results in a rapid decrease of spring pressure against the lips as wear of the seal takes place, causing the seal to leak with still much sealing material left. In the design of FIG. 12, the two cones 97 and 98 have their small diameters facing each other and the pressure on the lips is balanced and proportional to the pressure from the spring 100. As wear occurs, the cones move toward each other a distance proportional to the wear on the lips 62 and 63. Since the displacement is very small, the change in spring force is almost zero and the cones apply a uniform and constant pressure on the lips of the seal throughout its life. Because of the leak-free design of the seal, spring 100 is not exposed to the fluid and therefore will not be damaged by corrosive fluids, enabling the use of economically priced and readily available steel springs.

Figure 15:
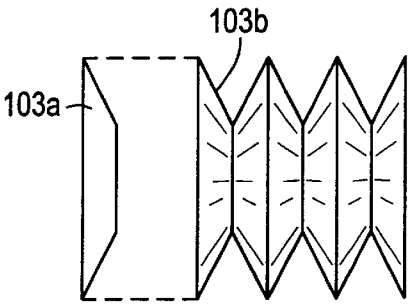
FIG. 15 illustrates several spring washers placed back to back to provide an urging mechanism for use in the seal shown in FIG. 12.
Figure 14:
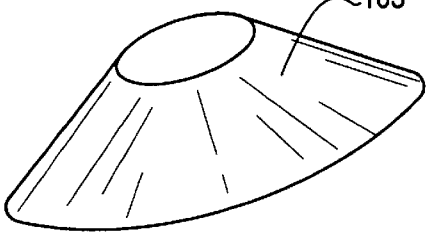
FIG. 14 illustrates a spring washer.

FIGS. 14 and 15 show a spring created by use of a steel spring washer 103. Several of these washers can be placed in the relationship shown in FIG. 15 to replace the coil spring 100 of FIG. 12. The spring rate of such a spring can be easily varied by placing one or more spring washers together as shown in FIG. 15 by washers 103*a* and 103*b*. The type of spring shown in FIGS. 14 and 15 can not only be advantageously used in the dual lip seal of FIG. 12, it can also be advantageously used in the compliant piston design of FIG. 6 as spring 59 and in the compliant cylinder design of FIG. 7 as springs 68 and 69.

FIGS. 16A–D illustrate another aspect of the invention in which one of the ports in the port plate 14 is shaped differently in order to accommodate special situations. FIGS. 16A–D show the port plate in cross-section above the cylinder head 20. Inlet port 16 and outlet port 15 are located in port plate 14 while the aperture 28 in cylinder head 20 is shown in hidden lines between the two ports. A land area 104 in port plate 14 is the area between the inlet and outlet ports.

Figure 16A:
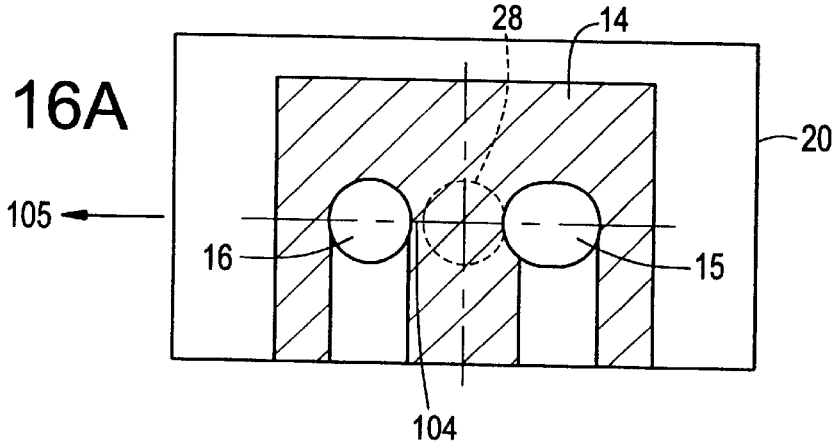
FIGS. 16A–D show various positions of the opening in the cylinder head with respect to the inlet and outlet ports of the port plate in which the ports have different configurations.
Figure 16B:
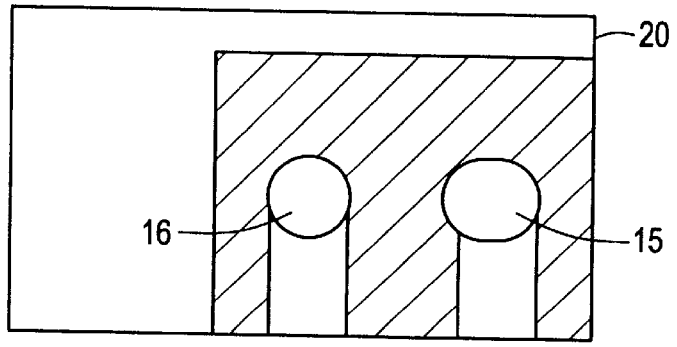
Figure 16C:
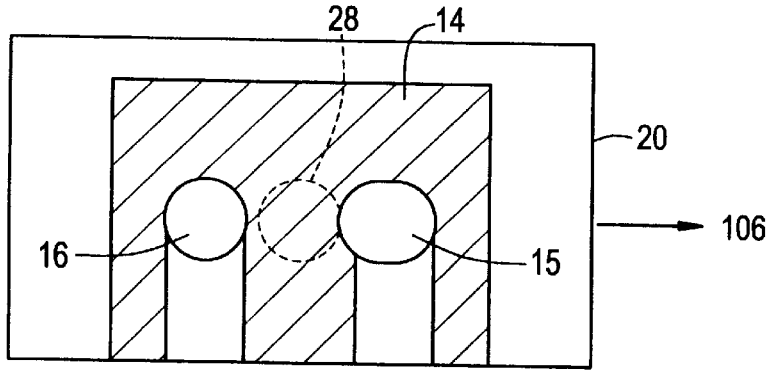
Figure 16D:
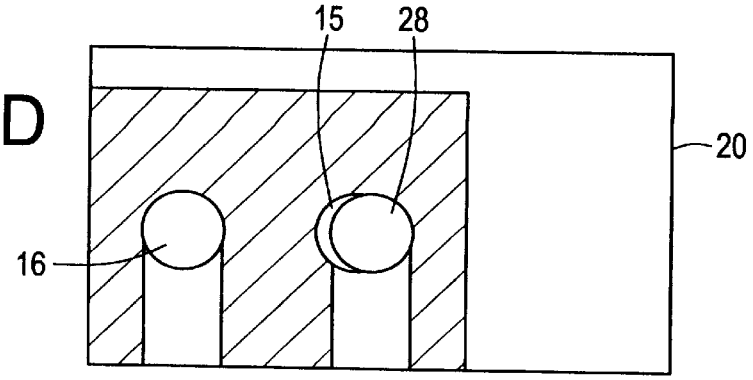

In FIG. 16A the aperture 28 is shown between the two ports with some amount of fluid communication remaining between aperture 28 and output port 15. As cylinder head 20 moves in the direction 105, the aperture 28 is brought into fluid communication with the inlet port 16 such that aperture 28 is no longer visible as shown in FIG. 16B. As cylinder head 20 moves back in the direction 106, the aperture 28 is once again located under the land area 104 between the inlet and outlet ports as shown in FIG. 16C. Fluid communication with the output port 15 is beginning to occur. In FIG. 16D the cylinder head 20 has moved to a position entirely under port 15. Aperture 28 is visible since the output port 15 is shaped larger than normal. Shaping the output port 15 in such a manner causes an increased time of fluid communication between the output port 15 and aperture 28 during operation of the device. In this manner, an increased time period for the exhaust of the displacement chamber is made available. Such an arrangement is desirable when an increased time period is needed to thoroughly exhaust the displacement chamber which might be the case when gases are pumped.

If rotation of the drive motor is reversed, the larger port 15 would become the intake port. When a highly viscous fluid is being pumped, it may be desirable to favor the inlet port in size to give more time for the fluid to fill the cylinder.

Figure 17:
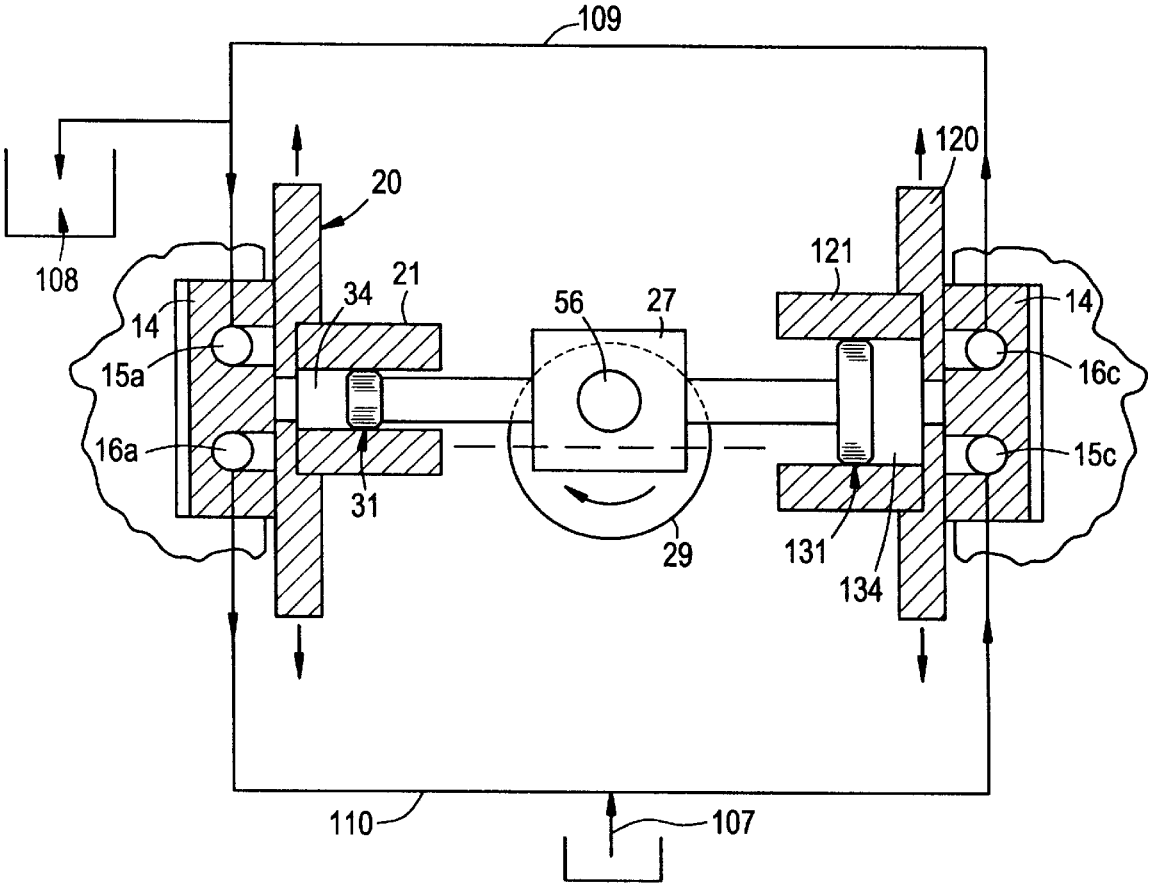
FIG. 17 is a schematic diagram showing a connection for differential displacement and the use of different sized cylinders in the device of FIG. 2.

FIG. 17 is a schematic drawing in partial cross-section showing a modification of the design of the fluid displacement module. The FDM incorporates a large piston 131 and large cylinder 121 with a normal sized piston 31 and normal sized cylinder 21 as opposing pistons within the FDM. The cylinder head 120 is a modified cylinder head to accommodate the larger cylinder 121. The FDM operates as previously explained with crankpin 56 and drive block 27 following a circular path 29 in a clockwise direction as shown. The result is equal piston strokes by the piston 31 and the piston 131 but an increased displacement in the right displacement chamber 134 by virtue of the increased size of the piston 131 and cylinder 121. Since the piston stroke is unchanged the ratio of displacement between the two cylinders is the ratio of the square of the radius of the cylinders. Therefore, if the radius of piston 131 is twice the size of the radius of piston 31, the displacement volume of chamber 134 is four times greater than the displacement of chamber 34. In that manner, an exact ratio of fluids pumped from the two displacement chambers is achieved. In such case, by precisely establishing the relative size of the pistons, any ratio between 1:1 and 4:1 can be achieved.

To achieve the above described capability of delivering fluids in a precise ratio, ports 15*a* and 16*a* are connected separately from ports 15*c* and 16*c*. In FIG. 17, however, a different connection is shown for purposes of illustrating differential displacement. For differential displacement the inlet port 15*c* is connected by line 110 to a fluid supply 107. Output line 108 is connected to line 109 which connects outlet port 16*c* with inlet port 15*a*. output port 16*a* is connected by line 110 to inlet port 15*c*.

On an intake stroke, fluid fills the displacement chamber 134. On the outlet stroke, fluid is moved through port 16*c* into line 109 which is connected to the inlet port 15*a* of displacement chamber 34. Since the amount of fluid pumped from displacement chamber 134 is larger than the amount needed to fill displacement chamber 34, the difference is pumped into the outlet reservoir 108. On the return stroke of piston 31 the fluid is pumped out of displacement chamber 34 into line 110 and on to the inlet port 15*c*. Consequently, only that amount of fluid needed to make up the difference to fill displacement chamber 134 is taken from the supply reservoir 107. Thus, by utilizing differential displacement connection, minute levels of output can be achieved where the two displacement chambers are close in size.

To further illustrate the versatility of the invention, a PFDD can be provided with two FDM's, i.e., four cylinders with a total displacement of 2.286 cc per revolution. A first cylinder may be sized to produce 1.6 cc per revolution, 70% of the total displacement, with an opposing second cylinder sized to produce 0.683 cc per revolution, 29.87% of the total displacement. Two additional cylinders in the second FDM are sized the same as the second cylinder but are differentially connected as shown in FIG. 17. Micro-adjustment of cylinder displacement can be used to create a minute differential displacement between cylinders three and four to achieve a differential displacement of 1% or less.

Differential displacement can also be achieved in minute amounts by incorporating a reduced stroke utilizing the variable displacement concepts disclosed in U.S. Pat. No. 5,004,404.

The structure shown in FIG. 17 can be used to produce high vacuum. If inlet port 16*a* is plugged, the inlet stroke of piston 31 will produce a vacuum in displacement chamber 34. That vacuum is exhausted through port 15*a* which can be connected to inlet port 16*c*, thus exhausting the vacuum into a large chamber 134 for production of a greater vacuum at exhaust port 15*c*.

It should be noted that the balanced design of the PFDD allows it to be driven by the fluid as a motor.

While the invention has been shown and described with reference to preferred embodiments thereof, it should be understood that changes in the form and details of the invention may be made therein without departing from the spirit and scope of the invention.

What is claimed is:

1. A positive fluid displacement device (PFDD) for delivering a fluid comprising a housing for said device;

a crankshaft mounted within said housing, said crankshaft for coupling to the driveshaft of a motor;

a crankpin connected to said crankshaft to provide an orbital movement around said crankshaft;

a fluid displacement module (FDM) for quick and easy assembly with said housing and said crankpin, said FDM having a first piston/cylinder assembly comprising a piston having a connecting end and a piston head, said connecting end connected to said crankpin to operably provide said piston with a circular motion;

a cylinder having a cylinder head, said cylinder head having a side enclosing one end of a displacement chamber, said cylinder for holding said piston, said piston head enclosing a second end of said displacement chamber;

said cylinder head having a flat surface on a side opposite to the side enclosing said displacement chamber; and an opening in said cylinder head, said opening allowing fluid communication to and from said displacement chamber, said piston head having a protrusion sized to fill said opening;

a first port plate having a flat surface which in assembly is in sealing engagement with the flat surface of said cylinder head, said port plate having two ports for fluid communication through said opening to said displacement chamber, one port being an inlet port to said displacement chamber and one port being an outlet port from said displacement chamber, in assembly said housing acts to hold said port plate from any substantial movement in two dimensions while allowing movement in one dimension;

a port plate spring located in assembly between said housing and said port plate to urge the flat surface of said port plate in said one dimension into sealing engagement with the flat surface of said cylinder head wherein said port plate is urged against said cylinder head in floating engagement therewith;

wherein in operation, the circular movement of said crankpin imparts a reciprocating movement to said cylinder, the flat surface of said cylinder head moving back and forth across the flat surface of said port plate once per revolution of said crankpin wherein said opening is successively brought into fluid communication with said inlet port and said outlet port;

said FDM having a second piston/cylinder assembly identical to said first piston/cylinder assembly, the second piston having a connecting end connected to said crankpin to provide an opposing piston/cylinder assembly; and a second port plate associated with said second piston/cylinder assembly, said second port plate identical to said first port plate.

2. The PFDD of claim 1 wherein said FDM further includes a cylinder carriage, said cylinder head securely fastened to said carriage to form a cylinder carriage/head assembly, said cylinder mounted on said carriage within a recess in said cylinder head.

3. The PFDD of claim 2 wherein said housing further includes grooves and wherein each said cylinder carriage/head assembly further includes an ear, said ear mating with an associated groove in assembly with said housing.

4. The PFDD of claim 1 wherein said cylinder and said cylinder head are both made of ceramic material.

5. The PFDD of claim 4 wherein said cylinder is made of one of a ceramic and a glass material.

6. The PFDD of claim 1 wherein each said piston/cylinder assembly further includes a piston seal assembly comprising a sealing ring having minimum clearance with the walls of said cylinder, said sealing ring made of compliant material;

said piston head having a first conical surface for engagement with said sealing ring;

a sleeve slidably mounted on said piston, said sleeve having a second conical surface for engagement with said sealing ring;

a retainer located on said piston; and an urging mechanism mounted between said retainer and said sleeve to urge said second conical surface into engagement with said sealing ring wherein said sealing ring is squeezed between said first and second conical surfaces to form two lips to engage the walls of said cylinder and provide a seal between said piston and said cylinder.

7. The PFDD of claim 6 further including an O-ring interposed between said piston head and said sleeve.

8. The PFDD of claim 7 wherein said urging mechanism is located on said piston at a position out of contact with said fluid.

9. The PFDD of claim 8 wherein said urging mechanism is comprised of a plurality of spring washers surrounding said piston.

10. The PFDD of claim 1 wherein the outlet port is shaped to enable fluid communication with the opening in the associated cylinder head for a larger portion of cylinder head movement than the inlet port.

11. The PFDD of claim 1 wherein the inlet port is shaped to enable fluid communication with the opening in the associated cylinder head for a larger portion of cylinder head movement than the outlet port.

12. The PFDD of claim 1 wherein said second piston/cylinder assembly is not identical to said first piston/cylinder assembly in that said second piston is larger in surface area than said first piston thereby displacing a greater quantity of fluid per revolution, said first and second pistons sized to provide output quantities of fluid in a predetermined ratio.

13. The PFDD of claim 1 further including a second FDM having third and fourth piston/cylinder assemblies with components in the same relationship defined for said first piston/cylinder assembly; and wherein in assembly the third and fourth pistons are connected to said crankpin at 180° from each other and at about 90° from the first and second pistons.

14. The PFDD of claim 13 wherein said third and fourth pistons are sized differently in surface area to provide a predetermined ratio of fluid quantity per revolution.

15. The PFDD of claim 12 further including a supply line and an output line and wherein the outlet port of the first port plate is connected to the inlet port of the second port plate and the outlet port of said second port plate is connected to the inlet port of said first port plate;

the inlet port of said second port plate connected to said supply line;

the outlet port of said second port plate connected to said output line; and wherein the quantity of fluid delivered to said outlet line per revolution is the difference in displacement of said first and second cylinders per revolution, wherein said device can deliver an exact predetermined quantity of fluid per revolution.

16. The PFDD of claim 1 further including an adjusting mechanism mounted within said housing for moving the position of said cylinder head relative to said housing toward or away from said piston head to alter the displacement of said device per revolution.

17. The PFDD of claim 16 including a compliant mounting for said cylinder head for movement of said cylinder head by said piston head should contact occur during a revolution.

18. The PFDD of claim 16 including a compliant mounting for said piston head for movement of said piston head should contact with said cylinder head occur during a revolution.

19. The PFDD of claim 1 wherein said device includes sensing mechanisms to indicate cylinder head position.

20. The PFDD of claim 19 further including a motor coupled to said crankshaft for driving said PFDD for a predetermined angular rotation in response to cylinder head position.

21. The PFDD of claim 1 further including a connecting line and wherein said connecting line connects the output port of the first port plate to the inlet port of the second port plate, wherein the inlet port of said first port plate is plugged, and wherein the outlet port of said second port plate delivers vacuum.

22. The PFDD of claim 12 further including a connecting line and wherein said connecting line connects the output port of said first cylinder to the inlet port of said second cylinder, wherein the inlet port of said first cylinder is plugged, and wherein the outlet port of said second cylinder delivers vacuum.

23. The PFDD of claim 1 further including a manifold connected in assembly to said housing, said manifold having fluid passageways for connection with the inlet and outlet ports of the port plates in the fluid displacement modules.

24. The PFDD of claim 12 further including a second FDM having third and fourth piston/cylinder assemblies with components in the same relationship defined for said first piston/cylinder assembly; and said third and fourth pistons are sized differently in surface area to provide a predetermined ratio of fluid quantity per revolution.

25. A method of eliminating valves and achieving near dead volume in a positive fluid displacement device (PFDD) employing pistons to draw fluid into displacement chambers and expel fluid therefrom, and to eliminate internal leakage in said PFDD, said method comprising providing a PFDD housing with a crankshaft and a crankpin, said crankpin providing circular motion around said crankshaft;

providing at least two pistons capable of being driven by said crankpin in a circular motion;

providing at least two cylinders, each cylinder having a cylinder head, said cylinders capable of being driven by said crankpin in a reciprocating motion;

providing an opening in each cylinder head for allowing fluid communication to and from the displacement chambers;

providing a protrusion on each piston, said protrusion sized to fill said opening when the piston is at top dead center to achieve near zero dead volume in the displacement chamber;

providing inlet and outlet ports for allowing alternating fluid communication through the opening to fill the displacement chamber on an intake stroke of the piston and to empty the displacement chamber on an exhaust stroke of the piston to achieve valveless operation;

providing a port plate containing said inlet and outlet ports, said port plate having a flat surface for mating with a flat surface on said cylinder head to provide a sealing relationship therebetween;

providing for a port plate mounting arrangement that allows said port plate to move in one dimension to maintain the sealing relationship with said cylinder head and to accommodate sufficient clearance of said cylinder head in two other dimensions to allow for movement in said one dimension; and providing for the maintenance of sufficient force on said port plate in a dimension perpendicular to the plane of reciprocating motion to maintain said sealing relationship and thereby eliminate internal leakage in said PFDD.

26. The method of claim 25 further including providing for a cylinder carriage to which said cylinder head is fastened to form a cylinder carriage/head assembly;

providing for driving said cylinder carriage/head assembly in a reciprocating fashion from the circular movement of said crankpin; and providing for the stable support of said cylinder carriage/head assembly by capturing the reciprocating movement in grooves connected to said housing.

27. The method of claim 25 further including providing for the elimination of wear particles which might otherwise contaminate delivered fluid by making said port plate and said cylinder head from ceramic material.

28. The method of claim 27 further including providing for a sealing relationship of said piston with said cylinder; and providing for the elimination of lubricating oil by making said relationship of said piston with said cylinder from compliant material, wherein the pumped fluid remains uncontaminated by wear particles and lubricant.

29. The method of claim 28 wherein said method includes providing for the pumping of fluid without the presence of shearing action on the transferred fluid by said PFDD thereby preventing damage to the transferred fluid.

30. The method of claim 25 wherein said method includes providing for the pumping of slurries by said PFDD without making special provision to prevent jamming of moving wetted parts in said PFDD.

31. The method of claim 30 wherein said PFDD is capable of pumping slurries without pressurizing the inlet port.

32. The method of claim 25 further including providing for a fluid displacement module (FDM) which, together with said port plate, includes all wetted parts;

wherein corrosive or dangerous fluids can be handled by said PFDD in a first operation and said PFDD can be used to handle a different fluid in a second operation by changing or cleaning only the FDM and port plates.

33. The method of claim 32 further including providing non-convoluted wide passageways to enter fluid through said inlet port to said displacement chamber; and providing non-convoluted wide passageways to empty fluid through said outlet port from said displacement chamber wherein turbulent flow and cavitation are prevented during operation of the device and cleaning of the FDM is facilitated by allowing a flushing/backwashing operation to completely clear the FDM.

34. The method of claim 25 further including providing said PFDD with the capability of operating equally well in either direction of crankshaft rotation.

35. The method of claim 25 further including providing for precision in the volume of delivered fluid to achieve fluid metering capability; and providing for precision in the volume of delivered fluid throughout the operational speed of said PFDD from low speeds to top-rated speed.

36. The method of claim 35 further including providing for specific mixing ratios of a plurality of delivered fluids by providing different diameter displacement chambers wherein a first fluid is pumped from a first smaller displacement chamber and a second fluid is pumped from a second larger displacement chamber; and providing for the maintenance of an accurate mixing ratio of said first and said second fluids for all PFDD flow rates.

37. The method of claim 36 further including providing for the delivery of said plurality of fluids through a specific angular rotation, said angular rotation including a partial crankshaft revolution and, if desired, a number of crankshaft revolutions.

38. The method of claim 36 further including providing for connection of the inlet port of said smaller chamber to the outlet port of said larger chamber and to a delivery line;

providing for connection of the outlet port of said smaller chamber to the inlet port of said larger chamber and to a supply line;

wherein the delivery of fluid per revolution is equal to the differential displacement of said chambers per revolution.

39. The method of claim 37 further including providing for connection of the inlet port of said smaller chamber to the outlet port of said larger chamber and to a delivery line;

providing for connection of the outlet port of said smaller chamber to the inlet port of said larger chamber and to a supply line;

wherein the delivery of fluid per revolution is equal to the differential displacement of said chambers per revolution.

40. The method of claim 25 further including providing for direct connection of an input line to the inlet port of said port plate; and providing for direct connection of an output line to the outlet port of said port plates.

41. The method of claim 25 further including providing for the interposition of a manifold to connect to said inlet and outlet ports of said port plates and to connect to input lines and output lines.

42. The method of claim 41 further including providing for sealing the manifold connection to the port plates to prevent escape of fluid.

43. The method of claim 25 further including providing a larger inlet port than outlet port to facilitate fluid filling of the displacement chamber.

44. The method of claim 25 further including providing a larger outlet port than inlet port to facilitate fluid discharge from the displacement chamber.

45. The method of claim 25 further including providing for plugging the inlet port of the smaller chamber; and providing for connecting the output line of the smaller chamber to the inlet port of the larger chamber to facilitate delivery of vacuum from said larger chamber.

46. The method of claim 25 further including providing for the delivery of a plurality of fluids from different displacement chambers.

47. The method of claim 25 further including providing for the delivery of fluid from one chamber; and providing for the delivery of vacuum from a second chamber.

48. The method of claim 25 further including providing for adjustment of cylinder head position relative to piston position at top dead center to facilitate near zero dead volume operation.

49. The method of claim 48 further including providing for a compliant cylinder head to accommodate contact between piston and cylinder head at top dead center.

50. The method of claim 48 further including providing for a compliant piston to accommodate contact between piston and cylinder head at top dead center.

51. The method of claim 25 further including providing for the optimization of port timing by providing for maximum fluid communication between a displacement chamber and inlet and output ports when the piston is travelling at maximum linear speed in a dimension parallel to the axis of the cylinder and when the cylinder head is at rest in order to optimize filling and discharge of the displacement chamber.

52. The method of claim 25 further including providing for the optimization of port timing by providing for a transfer in fluid communication to said displacement chamber from inlet port to output port or vice versa when the piston is at rest in a dimension parallel to the axis of the cylinder and when the cylinder head is travelling at maximum speed.

53. The method of claim 25 further including providing for the development of pressure ratios in excess of 100:1, said pressure ratio defined as the volume of a displacement chamber at bottom dead center divided by the volume of the same displacement chamber at top dead center.

* * * * *

UNITED STATES PATENT AND TRADEMARK OFFICE

CERTIFICATE OF CORRECTION

PATENT NO. : 6,162,030
DATED : December 19, 2000
INVENTOR(S) : Pierrat

It is certified that error appears in the above-identified patent and that said Letters Patent is hereby corrected as shown below:

Title page,
Item [56], References Cited, should include:

-- U.S. PATENT DOCUMENTS

| | | |
|---|---|---|
| 4,907,950 | 3/13/90 | Pierrat |
| 5,004,404 | 4/02/91 | Pierrat |
| 5,114,321 | 5/19/92 | Milburn et al. -- |

Signed and Sealed this

Thirty-first Day of December, 2002

JAMES E. ROGAN
*Director of the United States Patent and Trademark Office*